United States Patent [19]

Ochiai et al.

[11] Patent Number: 4,583,871

[45] Date of Patent: Apr. 22, 1986

[54] DOT PRINTER HEAD WITH MAGNETIC CIRCUIT THROUGH ADJACENT ARMATURES

[75] Inventors: Kuniaki Ochiai; Takashi Norigoe; Shigeo Komakine, all of Shizuoka, Japan

[73] Assignee: Tokyo Electric Co., Ltd., Tokyo, Japan

[21] Appl. No.: 725,505

[22] Filed: Apr. 24, 1985

Related U.S. Application Data

[63] Continuation of Ser. No. 556,297, Nov. 30, 1983, abandoned.

[30] Foreign Application Priority Data

Dec. 1, 1982 [JP] Japan ..... 57-211969

[51] Int. Cl.[4] ..... B41J 3/12; H01F 27/28

[52] U.S. Cl. ..... 400/124; 101/93.05; 336/184

[58] Field of Search ..... 400/124; 101/93.04, 101/93.05; 336/181, 184

[56] References Cited

U.S. PATENT DOCUMENTS 1,318,722 10/1919 Brackett ..... 336/184

4,437,775 3/1984 Ochiai et al. ..... 400/124

FOREIGN PATENT DOCUMENTS 56-55270 5/1981 Japan ..... 400/124

57-83464 5/1982 Japan ..... 400/124

*Primary Examiner*—Edgar S. Burr

*Assistant Examiner*—David A. Wiecking

*Attorney, Agent, or Firm*—Oblon, Fisher, Spivak, McClelland & Maier

[57] ABSTRACT

A dot printer head in which a radial array of armatures are disposed opposite to a yoke and cores equipped with coils, and the armatures are actuated together with needles by exciting the coils to perform a desired printing operation. In this arrangement, a magnetic flux generated from each core flows to the yoke via the associated armature and then returns to the former core while partially flowing through another magnetic path by way of the adjacent armature to the yoke and returning to the former core, whereby required magnetic paths are obtained without the necessity of increasing the areas of the mutually opposed surfaces of the armature and the yoke. Thus, the radial width of the yoke is reduced as well as the distance from the fulcrum of the armature to the core, so that the distance from the fulcrum of the armature to the fore end thereof can be sufficiently lengthened against the distance from the armature fulcrum to the core. Consequently, a great force of magnetic attraction is producible while the air gap between the armature and the core is maintained to be narrow, and furthermore the equivalent mass of the armature can be reduced to achieve high-speed printing with an economy of the power consumption.

4 Claims, 11 Drawing Figures

DOT PRINTER HEAD WITH MAGNETIC CIRCUIT THROUGH ADJACENT ARMATURES

This application is a continuation of application Ser. No. 556,297, filed Nov. 20, 1983, now abandoned.

FIELD OF THE INVENTION

The present invention relates to a dot printer and, more particularly, to a dot printer head equipped with a radial array of armatures so actuatable as to selectively drive a multiplicity of needles.

OBJECTS OF THE INVENTION

It is a first object of the present invention to increase the force of magnetic attraction of each core to an armature.

A second object of the invention resides in reducing the equivalent mass of each armature to perform a high-speed printing operation.

And a third object of the invention is to decrease the amount of power consumption.

DESCRIPTION OF THE PRIOR ART

Figure 1:
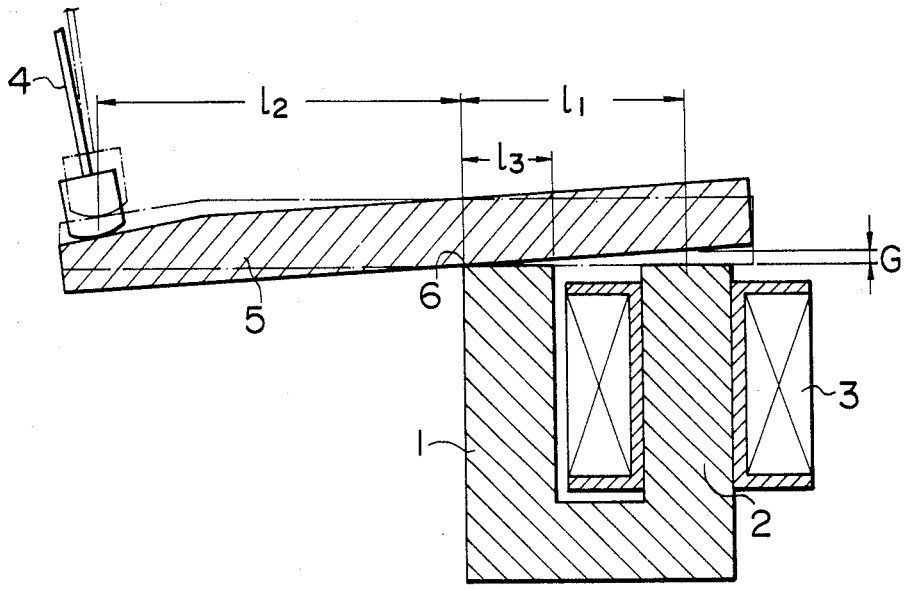
FIG. 1 PRIOR ART
FIG. 1 is a horizontal sectional view partially illustrating a conventional example with regard to the relationship among an armature, a core and a yoke therein.
Figure 2:
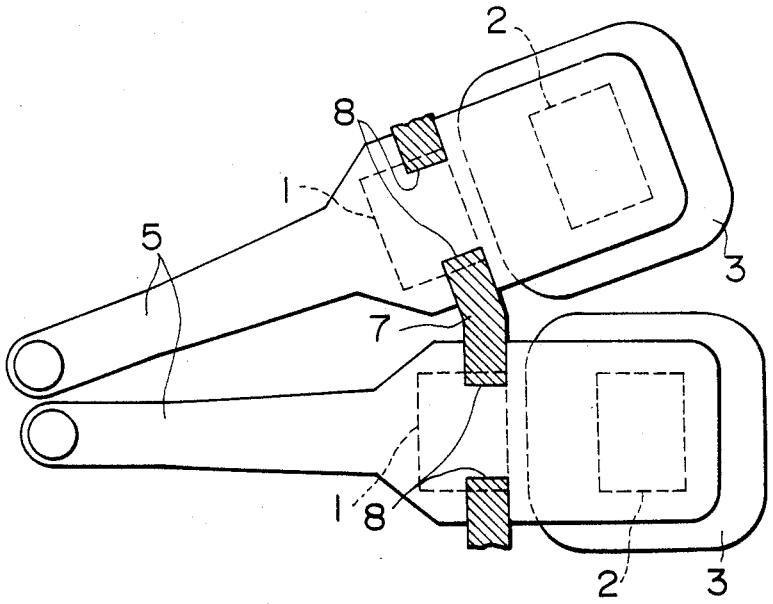
FIG. 2 PRIOR ART
FIG. 2 is a partially cutaway front view of the example shown in FIG. 1.
Figure 3:
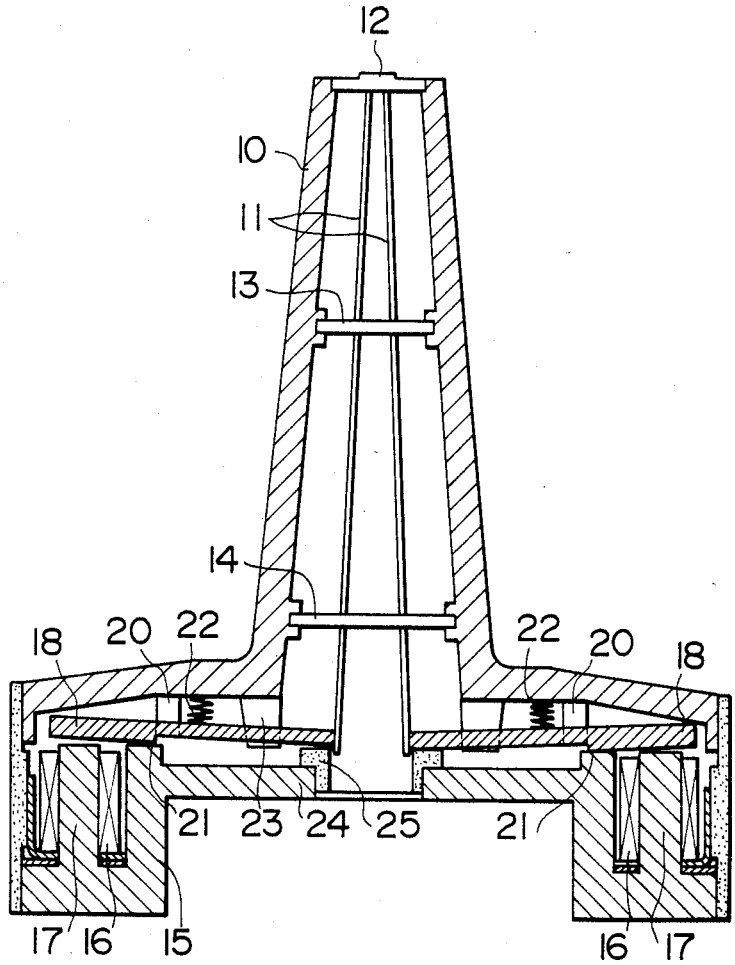
FIG. 3 is a reduced horizontal sectional view illustrating the entire structure of a first embodiment of the invention.
Figure 4:
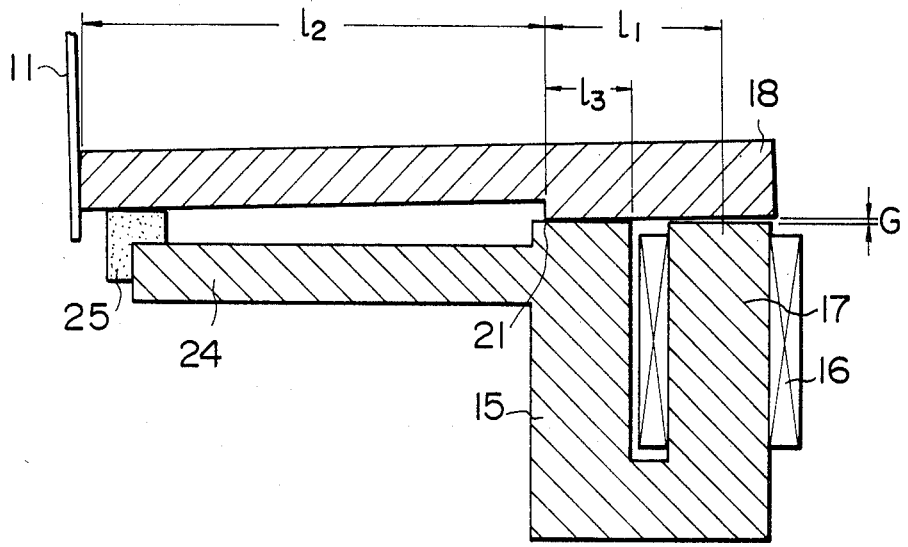
FIG. 4 is a horizontal sectional view illustrating principal portions of the first embodiment.
Figure 5:
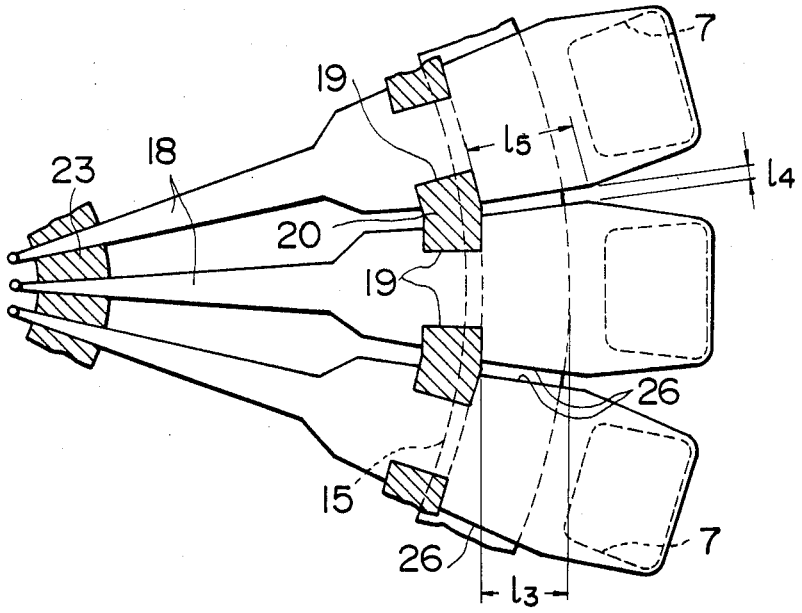
FIG. 5 is a partially cutaway front view of the first invention.
Figure 6:
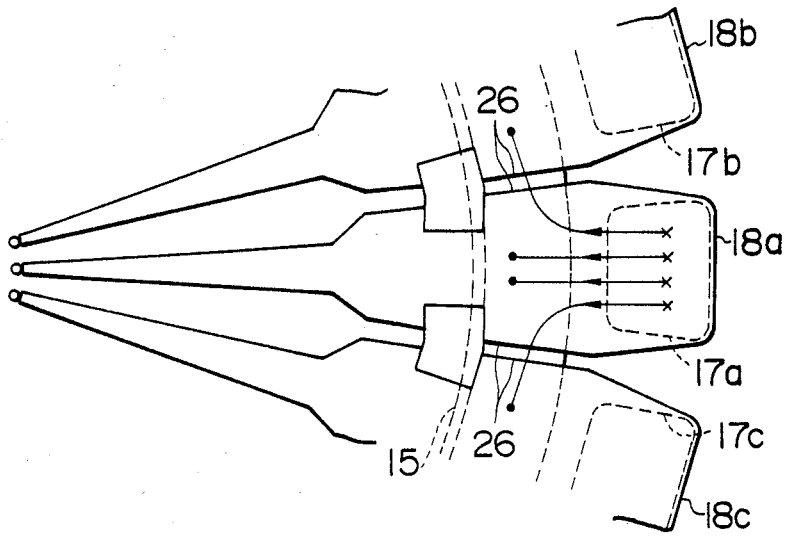
FIG. 6 is a front view illustrating the flow of a magnetic flux induced when one of coils is energized.
Figure 7:
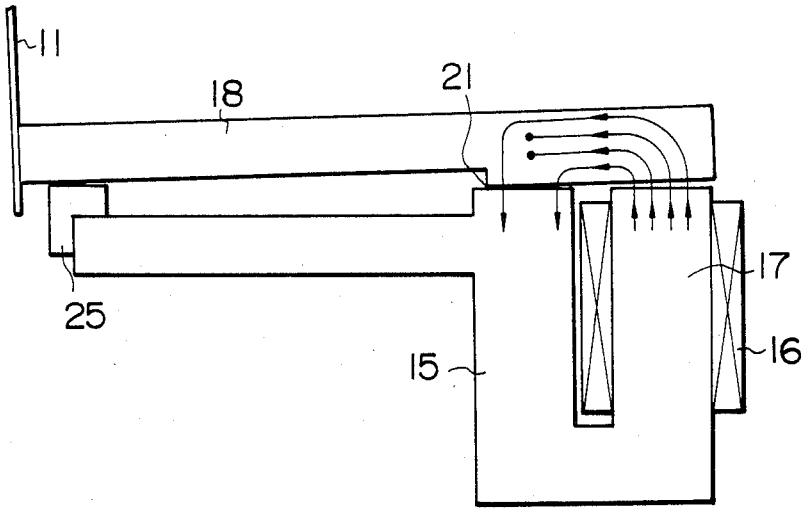
FIG. 7 is a plan view illustrating the flow of such magnetic flux seen from another direction.

In the known dot printer head of this type, an armature is actuated by exciting a coil and thereby causes a needle to collide with a platen to perform a desired printing operation. In general, a mechanism employed for driving the armature has a structure illustrated in FIGS. 1 and 2.

Coils (3) are wound individually around a plurality of cores (2) formed integrally with a yoke (1), and each of armatures (5) actuatable through excitation of the associated coil (3) for causing a needle (4) to collide with a platen is supported at a fulcrum (6) in such a manner as to be swingable upward and downward. And recesses (8) to be held by a guide member (7) are formed on the two sides of each armature (5). The guide member (7) is located within the surface opposed to the yoke (1). During the printing performed by exciting the coil (3) and attracting the armature (5) to the associated core (2), the magnetic flux generated from the core (2) flows to the yoke (1) via the armature (5) and then returns to the former core (2). Since it is necessary to maximize the force of magnetic attraction in the core (2) to carry out the intended printing, the surface of the armature (5) opposed to the yoke (1) needs to have a sufficiently great area to meet the requirement. However, in the structure of FIGS. 1 and 2 where each recess (8) formed on the surface opposed to the yoke (1) must be located in the armature (5) due to the positional relation to the guide member (7), it becomes a requisite to increase the radial width l3 of the yoke (1) for attaining a greater surface area of the armature (5) opposed to the yoke (1). With regard to the distance l1 from the fulcrum (6) to the center of the core (2) and the distance l2 from the fulcrum (6) to the striking point of a needle provided at the end of the armature (5), an increase of l3 brings about an increase of l1 to eventually widen an air gap G, whereby a sufficient force of magnetic attraction is rendered unattainable in the core (2). Furthermore, the lever ratio l2/l1 is lowered with an increase of the distance l1 to consequently augment the equivelent mass of the armature (5), so that high-speed printing is rendered impossible with another disadvantage of consuming a larger amount of electric power.

DESCRIPTION OF THE PREFERRED EMBODIMENTS

Hereinafter a first exemplary embodiment of the present invention will be described with reference to FIGS. 3 through 9, in which needle guide members (12, 13, 14) for slidably holding a plurality of needles (11) are secured to a guide frame (10), and an annular yoke (15) is attached to the guide frame (10) with screws. A plurality of cores (17) equipped with coils (16) are disposed in a radial array integrally with the yoke (15). Each of armatures (18) located opposite to the core (17) and the yoke (15) has recesses (19) on the two sides thereof, and guide portions (20) formed integrally with the guide frame (10) are fitted into the recesses (19) so that each armature (18) is swingable upward and downward on a fulcrum (21) while being energized elastically by means of a spring (22) in the direction to return to the former position. The guide frame (10) further has guide portions (23) for preventing lateral deflection of the fore ends of the armature (18). The annular yoke (15) includes a disk-shaped region (24) along its inner circumference to hold an armature stopper (25) thereon.

Each armature (18) has, on its two sides, surfaces (26) defined between the core (17) and the fulcrum (21) and opposed in parallel to the adjacent armatures (18) in a length l5 with a small space l4 maintained.

When any coil (16) is energized in the structure mentioned above, the associated armature (18) is magnetically attracted to the core (17) and thereby causes the needle (11) to collide with a platen. Supposing now that one selected coil (16) is energized in FIGS. 6 and 7, the magnetic flux generated from the core (17*a*) corresponding to the energized coil (16) comes to flow partially via the armature (18*a*) to a portion of the yoke (15) opposed to the armature (18*a*) and reaches the core (17*a*), while the remaining flux component flows further from the armature (18*a*) via the adjacent armatures (18*b*, 18*c*) to the yoke (15) and then returns to the former core (17*a*).

Figure 8:
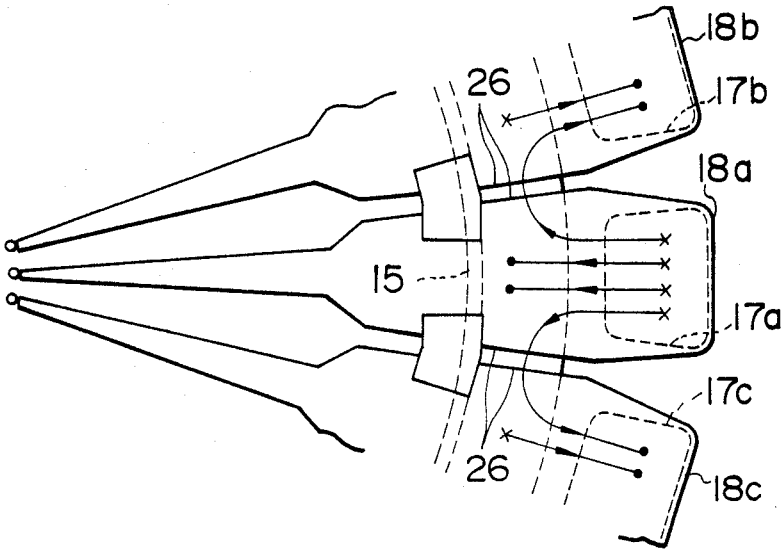
FIG. 8 is a front view illustrating the flow of a magnetic flux when all of the coils are energized.
Figure 9:
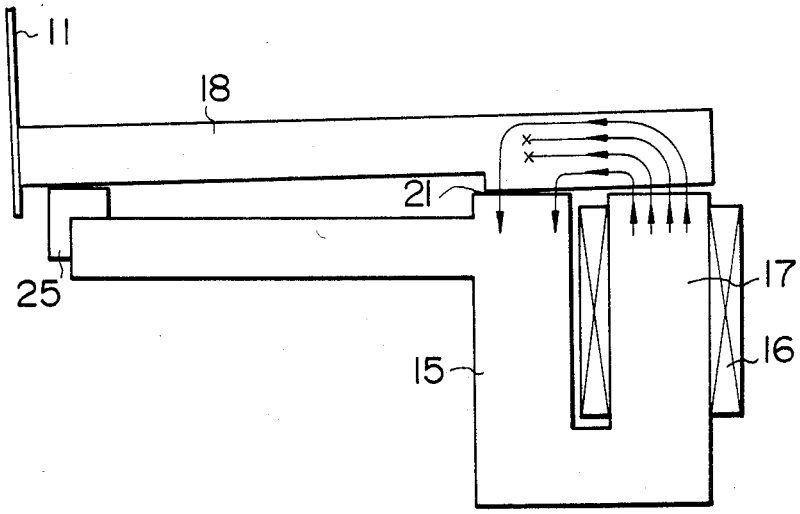
FIG. 9 is a plan view illustrating the flow of such magnetic flux seen from another direction.

In the case of exciting all of the coils (16), the same effect is achievable by circumferentially alternating the directions of the respective magnetic fluxes induced by the coils (16), as illustrated in FIG. 8. This may be accomplished, for example, by alternating the direction of the core windings from one core to the next. In this case, the magnetic flux generated from the core (17*a* ) partially flows to the yoke (15) via the armature (18*a*) and then returns to the core (17*a*) while the remaining flux component having reached the armature (18*a*) further flows therefrom to the adjacent armature (18*b*) or (18*c*) and arrives at the adjacent core (17*b*) or (17*c*).

Due to the above arrangement where the magnetic flux is allowed to partially flow to the yoke (15) via the adjacent armature (18) and returns to the former core (17), a satisfactory magnetic path is obtainable even though the surface of the armature (18) opposed to the yoke (15) has a small area. As a result, the radial width of the yoke (15) is reducible to lessen the distance l3, whereby the distance l1 from the fulcrum (21) to the center of the core (17) can be rendered smaller to eventually narrow the air gap G between the core (17) and the armature (18). Therefore, it becomes possible to produce a sufficiently great force of magnetic attraction. Since the distance l1 is thus decreasable in relation to the distance l2 from the fulcrum (21) to the needle (11), the ratio l2/l1 can be increased to bring about a reduction in the equivalent mass of the armature (18), so that the structure is rendered optimal for high-speed printing with an economic advantage regarding the power consumption.

Figure 10:
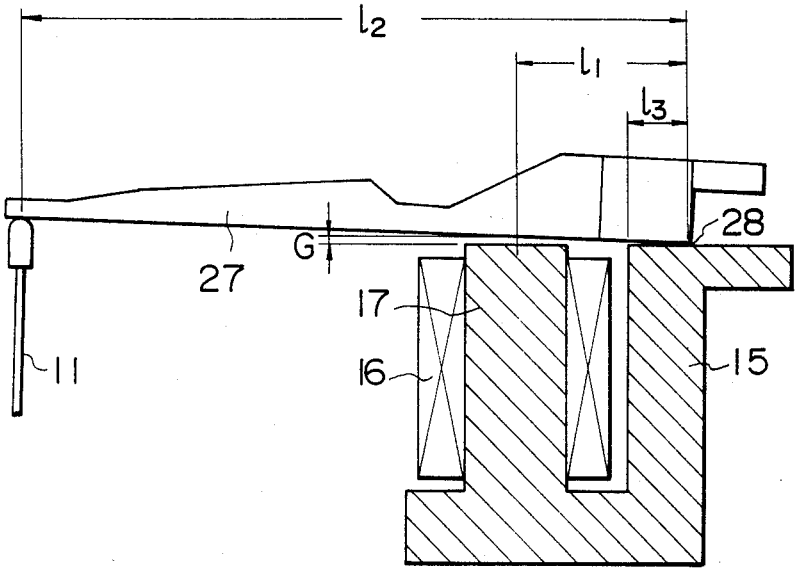
FIG. 10 is a partial plan view of a second embodiment of the present invention with a yoke shown in horizontal section.
Figure 11:
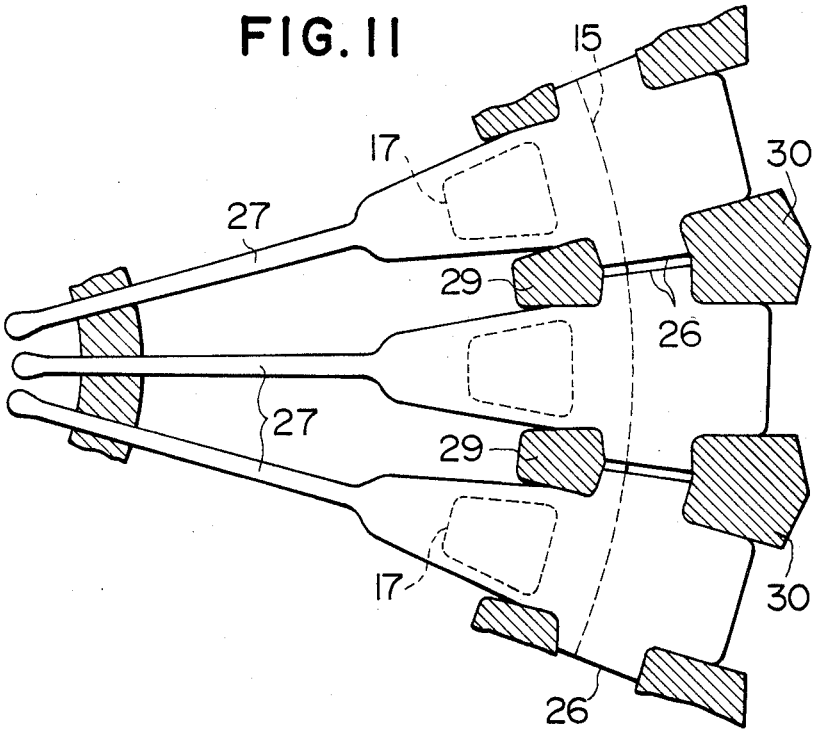
FIG. 11 is a partially cutaway front view of the second embodiment.

In a second exemplary embodiment of this invention illustrated in FIGS. 10 and 11, the same reference numerals as those used in the foregoing embodiment denote the identical components, and a repeated explanation is omitted. Differing from the foregoing embodiment where the cores (17) are disposed along the outer circumference of the annular yoke (15), the second embodiment is so arranged that the cores (17) are disposed along the inner circumference of the yoke (15). Accordingly, the fulcrum (28) of each armature (27) is located outside of the associated core (17). Each armature (27) has surfaces (26) opposed to the adjacent armatures (27), and guide portions (29, 30) for guiding the two sides of the armature (27) are formed in the guide frame (10).

Consequently, the magnetic flux generated from each core (17) is allowed to partially flow via the adjacent armatures (27) to the yoke (15). Therefore, it becomes possible to diminish the surface area of the armature (27) opposed to the yoke (15), hence reducing the radial width of the yoke (15) to shorten the distance l3 for decreasing the distance l1 from the fulcrum (28) to the center of the core (17), whereby the air gap G between the core (17) and the armature (27) can be narrowed to eventually lessen the ratio l2/l1.

What is claimed is:

1. A dot printer head comprising:

an annular yoke;

a plurality of cores disposed in an annular pattern, radially displaced from said yoke;

a plurality of coils wound around said cores;

means for providing magnetic flux in said cores such that a polarity of said flux in each said core is opposite said flux polarity in each core immediately adjacent said core; and a plurality of armatures disposed adjacent said yoke and cores for operating a plurality of printing needles, each said armature being pivotable on said yoke about a fulcrum, said armatures being disposed such that each armature is adjacent to two neighboring armatures, wherein each armature further comprises, on each of two sides thereof, a magnetic coupling surface opposed to the adjacent armature and spaced therefrom, said magnetic coupling surfaces on adjacent armatures being substantially parallel to each other, being sufficiently close to each other to establish effective magnetic coupling, comprising the closest approach of each armature to its neighboring armature, and being disposed immediately adjacent said yoke.

2. The dot printer head as defined in claim 1, wherein said magnetic coupling surfaces of each said armature are, in the radial direction, located between the armature surface opposed to the associated core and the fulcrum of said armature, and are located at a position closer to said fulcrum than to said associated core.

3. The dot printer head as defined in claim 2, wherein the distance between those portions of adjacent armatures which are opposed to the associated cores is everywhere greater than the distance between those portions of adjacent armatures which are opposed to the yoke.

4. The dot printer head of claim 1 wherein said means for providing opposite magnetic flux polarity comprises alternating opposite windings in adjacent coils.

* * * * *